US008003592B2

(12) United States Patent
Brooker et al.

(10) Patent No.: US 8,003,592 B2
(45) Date of Patent: Aug. 23, 2011

(54) PARTICLE FOR IMPARTING A FABRIC-SOFTENING BENEFIT TO FABRICS TREATED THEREWITH AND THAT PROVIDES A DESIRABLE SUDS SUPPRESSION

(75) Inventors: Alan Thomas Brooker, Newcastle upon Tyne (GB); Fabrizio Meli, Tyne and Wear (GB); Kevin Graham Blyth, Tyne and Wear (GB); Nigel Patrick Somerville Roberts, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 122 days.

(21) Appl. No.: 12/496,663

(22) Filed: Jul. 2, 2009

(65) Prior Publication Data

US 2010/0009887 A1 Jan. 14, 2010

(30) Foreign Application Priority Data

Jul. 14, 2008 (EP) ..... 08160345

(51) Int. Cl.
*C11D 3/37* (2006.01)
*C11D 9/36* (2006.01)

(52) U.S. Cl. ..... 510/349; 510/276; 510/287; 510/342; 510/343; 510/347; 510/438; 510/444; 510/466; 510/515

(58) Field of Classification Search ..... 510/276, 510/287, 342, 343, 347, 349, 438, 444, 466, 510/515
See application file for complete search history.

(56) References Cited

U.S. PATENT DOCUMENTS

| | | | | |
|---|---|---|---|---|
| 5,013,763 | A * | 5/1991 | Tubesing et al. | 514/772 |
| 5,496,861 | A * | 3/1996 | Rouse et al. | 514/778 |
| 5,720,964 | A * | 2/1998 | Murray | 424/401 |
| 5,958,397 | A * | 9/1999 | Smerbeck et al. | 424/78.03 |
| 5,965,515 | A | 10/1999 | Rau | |
| 5,980,877 | A * | 11/1999 | Baravetto et al. | 424/70.12 |
| 6,869,923 | B1 * | 3/2005 | Cunningham et al. | 512/4 |
| 2003/0109391 | A1 * | 6/2003 | Midha et al. | 510/122 |
| 2003/0195133 | A1 | 10/2003 | Shefer et al. | |
| 2004/0235689 | A1 * | 11/2004 | Sakai et al. | 510/119 |
| 2005/0164898 | A1 * | 7/2005 | Kasturi et al. | 510/237 |
| 2005/0209126 | A1 | 9/2005 | Farooq et al. | |
| 2006/0160714 | A1 * | 7/2006 | Terada | 510/119 |
| 2007/0077221 | A1 * | 4/2007 | Seigneurin et al. | 424/70.16 |
| 2008/0139432 | A1 * | 6/2008 | Peffly et al. | 510/122 |
| 2008/0311066 | A1 * | 12/2008 | Samain et al. | 424/70.16 |
| 2009/0074699 | A1 * | 3/2009 | Biganska et al. | 424/70.16 |
| 2009/0130038 | A1 * | 5/2009 | Biganska et al. | 424/61 |
| 2009/0169502 | A1 * | 7/2009 | Quadir | 424/70.9 |
| 2009/0175817 | A1 * | 7/2009 | Li et al. | 424/70.11 |
| 2010/0105592 | A1 * | 4/2010 | Yoda et al. | 510/119 |

FOREIGN PATENT DOCUMENTS

WO WO 2007/028773 A 3/2007

OTHER PUBLICATIONS

EPO International Search Report Dated Jan. 22, 2009—3 pgs.

* cited by examiner

*Primary Examiner* — Charles Boyer
(74) *Attorney, Agent, or Firm* — Julie A. McConihay; Leonard W. Lewis; Steven W. Miller

(57) ABSTRACT

The present invention relates to a particle comprising: (a) solid film-forming polymeric material; (b) liquid fabric-softening component; and (c) cationically charged polymeric material.

8 Claims, No Drawings

PARTICLE FOR IMPARTING A FABRIC-SOFTENING BENEFIT TO FABRICS TREATED THEREWITH AND THAT PROVIDES A DESIRABLE SUDS SUPPRESSION

FIELD OF THE INVENTION

The present invention relates to a particle that deposits a fabric-softening benefit agent onto fabrics treated therewith. The present invention also relates to compositions and agglomerates that comprise such particles. In addition, the present invention relates to methods to produce such compositions, agglomerates and particles.

The particle comprises a solid film-forming polymeric material, liquid fabric-softening component and cationically charged polymeric material.

BACKGROUND OF THE INVENTION

Laundry detergent compositions that both clean and soften fabric during a laundering process are known and have been developed and sold by laundry detergent manufacturers for many years. Typically, these laundry detergent compositions comprise components that are capable of providing a fabric-softening benefit to the laundered fabric; such fabric-softening components include silicone.

The use of silicone to provide a fabric-softening benefit to laundered fabric during a laundering process is known. U.S. Pat. No. 4,585,563 (Busch, A., and Kosmas, S.; The Procter & Gamble Company) describes that specific organo-functional polydialkylsiloxanes can advantageously be incorporated in granular detergents to provide remarkable benefits inclusive of through-the-wash softening and further textile handling improvements. U.S. Pat. No. 5,277,968 (Canivenc, E.; Rhone-Poulenc Chemie) describes a process for the conditioning of textile substrates to allegedly impart a pleasant feel and good hydrophobicity thereto, comprising treating such textile substances with an effective conditioning amount of a specific polydiorganosiloxane. U.S. Pat. No. 4,419,250 (Allen, E., Dillarstone, R., and Reul, J. A.; Colgate-Palmolive Company) describes agglomerated bentonite particles that comprise a salt of a lower alkyl siliconic acid and/or a polymerization product(s) thereof. U.S. Pat. No. 4,421,657 (Allen, E., Dillarstone, R., and Reul, J. A.; Colgate-Palmolive Company) describes a particulate heavy-duty laundering and textile-softening composition comprising bentonite clay and a siliconate. U.S. Pat. No. 4,482,477 (Allen, E., Dillarstone, R., and Reul, J. A.; Colgate-Palmolive Company) describes a particulate built synthetic organic detergent composition which includes a dispensing assisting proportion of a siliconate and preferably bentonite as a fabric-softening agent. In another example, EP 0 163 352 (York, D. W.; The Procter & Gamble Company) describes the incorporation of silicone into a clay-containing laundry detergent composition in an attempt to control the excessive suds that are generated by the clay-containing laundry detergent composition during the laundering process. EP 0 381 487 (Biggin, I. S., and Cartwright, P. S.; BP Chemicals Limited) describes an aqueous based liquid detergent formulation comprising clay that is pretreated with a barrier material such as a polysiloxane.

Detergent manufacturers have also attempted to incorporate a silicone, clay and a flocculant in a laundry detergent composition. For example, a fabric treatment composition comprising substituted polysiloxanes, softening clay and a clay flocculant is described in WO92/07927 (Marteleur, C. A. A. V. J., and Convents, A. C.; The Procter & Gamble Company).

More recently, fabric care compositions comprising an organophilic clay and functionalized oil are described in U.S. Pat. No. 6,656,901 B2 (Moorfield, D., and Whilton, N.; Unilever Home & Personal Care USA division of Conopco, Inc.). WO02/092748 (Instone, T. et al; Unilever PLC) describes a granular composition comprising an intimate blend of a non-ionic surfactant and a water-insoluble liquid, which may a silicone, and a granular carrier material, which may be a clay. WO03/055966 (Cocardo, D. M., et al; Hindustain Lever Limited) describes a fabric care composition comprising a solid carrier, which may be a clay, and an anti-wrinkle agent, which may be a silicone.

WO2005/075616, WO2005/075618, WO2005/075619, WO2005/07620, WO2005/075622, WO2007/017799, WO2007/017800 and WO2007/017801 all relate to detergent compositions comprising a silicone fabric softener.

However, whilst these fabric softening agents provide good fabric-softening performance, they have a negative impart on the sudsing profile of the detergent composition. More specifically, the sudsing is prematurely curtailed in the early stages of the washing cycle. Consumers associate the presence of suds with good cleaning performance. Prematurely and drastically reducing the suds during the washing cycle is disliked by consumers and is detrimental to their product acceptance.

The present invention provides a particle that provides a good fabric-softening benefit without significantly affecting the sudsing profile of the laundry detergent composition. The particle can easily be incorporated into laundry detergent compositions, especially solid laundry detergent compositions, or other, e.g. rinse-added, compositions, to provide fabric-softening benefits thereto. Compositions that comprise the particle of the present invention exhibit good fabric-softening performance, and have desirable sudsing profiles that are not detrimental to the consumers' acceptance of the product.

The particle comprises (a) solid film-forming polymeric material, (b) liquid fabric-softening component; and (c) charged polymeric material, preferably that is capable of increasing the viscosity of the film-forming polymer in an aqueous environment.

Without wishing to be bound by theory, the Inventors believe that the charged polymeric material interacts with the solid film-forming polymeric material, likely through an ion-pair formation, so as to form an extended gel structure upon contact with water. This in turn leads to an improved softening performance and also minimizes any impact the softening component may have on the sudsing profile of the composition, especially in the early stages of the washing cycle.

SUMMARY OF THE INVENTION

The present invention relates to a particle as defined by the claims. In separate embodiments, the present invention also relates to compositions and agglomerates that comprise such particles as defined by the claims. In further embodiments, the present invention also relates to methods to produce such compositions, agglomerates and particles as defined by the claims.

DETAILED DESCRIPTION OF THE INVENTION

Particle: The particle comprises: (a) solid film-forming polymeric material; (b) liquid fabric-softening component;

and (c) charged polymeric material. The solid film-forming polymeric material is described in more detail below. The liquid fabric-softening component is described in more detail below. The charged polymeric material is described in more detail below.

Preferably, the charged polymeric material is capable of increasing the viscosity of the film-forming polymer in an aqueous environment. The method of measuring this viscosity increase is described in more detail below.

The particle preferably comprises: (a) from 20 wt % to less than 99 wt % solid film-forming polymeric material; (b) from 1 wt % to 80 wt % liquid fabric-softening component; and (c) from above 0 wt % to 20 wt % charged polymeric material.

The particle may comprise: (a) from 40 wt % to 60 wt % solid film-forming polymeric material; (b) from 40 wt % to 60 wt % liquid fabric-softening component; and (c) from 1 wt % to 10 wt % charged polymeric material.

The particle typically has a weight average particle diameter of from 1 micrometer to 200 micrometers, preferably from 2 micrometers, or from 10 micrometers, and preferably to 150, or to 120 micrometers.

The particle preferably has a weight average particle diameter of from 1 micrometer to 40 micrometers.

Solid film-forming polymeric material: Preferably, the solid film-forming polymeric material comprises polysaccharide, polydextrin, polyvinylalcohol and/or starch. Preferably, the solid film-forming polymeric material comprises starch or starch derivative, preferably anionically modified starch. The solid film forming polymeric material is preferably selected from maltodextrin and/or alkyl succinic acid derivatized starch. Most preferably, the solid film-forming polymeric material comprises an alkyl succinic acid derivatized starch, preferably octyl succinic acid derivatized starch.

Typically, the solid film-forming polymeric material is capable of emulsifying the liquid fabric-softening component in an aqueous environment.

Typically, the solid film-forming polymeric material encapsulates at least part of the liquid fabric-softening component.

Preferably, the solid film-forming polymeric material is charged. Preferably, the film-forming polymeric material is capable of forming an ion-pair with the charged polymeric material.

Preferably, the solid film-forming polymeric material is water-soluble. Preferably, the solid film-forming polymeric material has a water-solubility of at least 50%, or at least 60%, or at least 70%, or at least 80%, at least 90%, or at least 95%, or even at least 99%. The method typically used to determine water-solubility is described in more detail below.

Liquid fabric-softening component: Preferably, the liquid fabric-softening component comprises hydrophobic oil. Preferably, the liquid fabric-softening component comprises silicone. More preferably, the liquid fabric-softening component comprises polydimethylsiloxane. Preferably, the liquid fabric-softening component comprises polydimethylsiloxane having a viscosity of at least 10,000 cP, at a shear rate of 20 $s^{-1}$ and at a temperature of 25° C.

Preferably, the liquid fabric-softening component comprise one or more of mineral oil, vegetable oil, hydrogenated caster oil, polyol esters, fatty acids and hydrocarbons.

Preferably, the liquid fabric-softening component is not a perfume. Preferably, the liquid fabric-softening component has an odor detection threshold of at least 10 ppm. The method for typically determining the odor detection threshold is described in more detail below.

Charged polymeric material: Preferably, the charged polymeric material is capable of increasing the viscosity of the film-forming polymer in an aqueous environment. Preferably, the viscosity increase is at least a factor of 1.1, preferably 1.2, or even at least 1.5, or even at least 1.7, or even at least 2.0, or even at least 3.0, when measuring the viscosity in units of Pas at a shear rate of 20 $s^{-1}$ and at a temperature of 25° C.

Preferably, the charged polymeric material is cationically charged, typically the charged polymeric material is cationically charged at a pH of 7.0. More preferably, the charged polymeric material is cationically charged and the solid film-forming polymeric material is anionically charged: this is especially preferred when additionally the cationically charged polymeric material is capable of forming an ion-pair with the anionically charged solid film-forming polymer in an aqueous environment.

Preferably, the charged polymeric material is water-soluble.

Preferably, the charged polymeric material comprises a quaternary nitrogen group.

Preferably, the charged polymeric material comprises a cellulosic material.

Preferably, the charged polymeric material comprises cationic cellulosic material. More preferably, the charged polymeric material comprises cationic hydroxyl ethyl cellulose.

Viscosity measurement: Typically, the viscosity increase of the film-forming polymer upon contact with the charged polymeric material is determined by the following method. An aqueous solution of the film-forming polymer is prepared at a concentration such that its viscosity is 0.05 Pas when determined using a Paar Physica UDS200 Rheometer at a shear rate of 20 $s^{-1}$ and at a temperature of 25° C. following the manufacturer's guidelines. 0.83 g of charged polymeric material is added to 50 ml of the solution of the film-forming polymer. The solution is stirred at speed setting 3 using an IKA T25 stirrer for 5 minutes at room temperature. The solution is allowed to stand for 30 minutes at room temperature. The viscosity of the solution is then determined using a Paar Physica UDS200 Rheometer at a shear rate of 20 $s^{-1}$ and at a temperature of 25° C. following the manufacturer's guidelines.

Water-solubility: Typically, the water-solubility of the film-forming polymeric material is determined by the following method:

1. Measure 100 mL of distilled water at 60° C. into an IKA T25 mixer.
2. Turn the mixer on slow speed (speed setting 1) and immediately add 1.0 gram of film-forming polymeric material into the distilled water.
3. Immediately, stir the solution for 5 minutes on high speed (speed setting).
4. Immediately, pass the solution through a 30 micrometer filter.
5. Dry a 25 mL portion of solution to constant weight in an oven at 105° C. Weigh to determine the amount of recovered material.

Water solubility is expressed as a percentage of the starting material recovered, and is calculated by: gram weight of recovered material from the 25 ml portion multiplied by 400.

Odor detection threshold: Typically, the odor detection threshold of the fabric-softening component is determined by the method described in: "Compilation of Odor and Taste Threshold Value Data (ASTM DS 48 A) 1978", edited by F. A. Fazzalari, International Business Machines, Hopwell Junction, N.Y.

Fabric treatment composition: The fabric treatment composition comprises the particle of the present invention. In a separate embodiment, the fabric treatment composition comprises an agglomerate of the present invention.

Preferably, the fabric treatment composition is in solid form, preferably powder form. The composition can be in the form of a tablet, a unit dose pouch, powder, liquid or a gel. The composition typically comprises adjunct detersive components. The composition typically has a bulk density in the range of from 300 g/l to 1,000 g/l. If the composition is in powder form, the composition typically has a particle size distribution such that preferably the weight average particle size of the composition is in the range of from 300 micrometers to 800 micrometers, and preferably no more than 10 wt % of the particles have a particle size of less than 200 micrometers, and preferably no more than 10 wt % of the particles have a particle size of greater than 1,000 micrometers. The composition typically comprises detersive surfactant, preferably anionic detersive surfactant. The composition may comprise perfume microcapsule. The composition may comprise hueing agent. The composition typically comprises adjunct detergent components.

The composition may comprise low levels of builder. Preferably, the composition comprises from 0 wt % to 10 wt % zeolite builder. The composition may also comprise from 0 wt % to 10 wt % phosphate builder.

The composition may also comprise low levels of carbonate salt. The composition may comprise from 0 wt % to 10 wt % carbonate salt. A suitable carbonate salt is sodium carbonate.

Adjunct detergent components: The composition typically comprises adjunct detergent components. These adjunct detergent components include: bleach such as percarbonate and/or perborate, preferably in combination with a bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; bleach boosters such as iminium cations and polyions, iminium zwitterions, modified amines, modified amine oxides, N-sulphonyl imines, N-phosphonyl imines, N-acyl imines, thiadiazole dioxides, perfluoroimines, cyclic sugar ketones and mixtures thereof, especially preferred is a 3,4-dihydroisoquinolinium derived bleach booster; bleach catalysts including coordinated transition metal bleach catalysts; chelants such as diethylene triamine pentaacetate, diethylene triamine penta(methyl phosphonic acid), ethylene diamine-N'N'-disuccinic acid, ethylene diamine tetraacetate, ethylene diamine tetra (methylene phosphonic acid) and hydroxyethane di(methylene phosphonic acid); enzymes such as amylases, carbohydrases, cellulases, laccases, lipases, oxidases, peroxidases, proteases, pectate lyases, mannanases, xyloglucanases; hueing agents; perfume microcapsules; carbonate salts such as sodium carbonate and/or sodium bicarbonate; suds suppressing systems such as silicone or soap based suds suppressors; brighteners; photobleach; filler salts such as sodium sulphate; solid fabric-softening agents such as clay and/or cationic quaternary amine softening performance; flocculants such as polyethylene oxide; buffers such as silicate salts, especially sodium silicate; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as polycarboxylates, alkoxylated polyamines and ethoxylated ethyleneimine polymers; anti-redeposition components such as carboxymethyl cellulose and polyesters; perfumes; and dyes.

Agglomerate: The agglomerate comprises (a) two or more particles of the present invention; (b) optionally a binder; and (c) optionally a flow aid.

Binder: Suitable binders include water or water-containing mixture, hot-melts such as polyethyleneglycol, surfactants, and mixtures thereof.

Flow aid: Suitable flow aids include silica, aluminosilicates including zeolite, non-hydrating inorganic salts such as burkeite, carbonate and/or sulphate preferably in micronized particulate form, corn starch, and mixtures thereof.

Laundry detergent composition: The laundry detergent composition comprises a detersive surfactant and a particle of the present invention. In a separate embodiment, the laundry detergent composition comprises an agglomerate of the present invention. Preferably, the laundry detergent composition is in solid form.

Detersive surfactant: The detersive surfactant is typically anionic detersive surfactant, non-ionic detersive surfactant, cationic detersive surfactant, or zwitterionic detersive surfactant. The detersive surfactant may be amphoteric detersive surfactant.

Suitable anionic detersive surfactants are alkoxylated alcohol sulphate anionic detersive surfactants such as linear or branched, substituted or unsubstituted ethoxylated $C_{12-18}$ alcohol sulphates having an average degree of ethoxylation of from 1 to 10, preferably from 3 to 7. Other suitable anionic detersive surfactant are alkyl benzene sulphonate anionic detersive surfactants such as linear or branched, substituted or unsubstituted $C_{8-18}$ alkyl benzene sulphonates, preferably linear unsubstituted $C_{10-13}$ alkyl benzene sulphonates. Other suitable anionic detersive surfactants are alkyl sulphates, alkyl sulphonates, alkyl phosphates, alkyl phosphonates, alkyl carboxylates or any mixture thereof.

Suitable non-ionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10. The non-ionic detersive surfactant may be an alkyl polyglucoside.

Suitable cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Process of preparing the particle of the present invention: The process comprises the steps of forming an emulsion with the liquid fabric-softening component.

Preferably, at least one of the solid film-forming polymeric material and/or the charged polymeric material is in the form of an aqueous mixture when contacted with the liquid fabric-softening component.

Preferably, both the solid film-forming polymeric material and the charged polymeric material are in the form of an aqueous mixture when contacted with the liquid fabric-softening component.

At least two of the solid film-forming polymeric material and/or the charged polymeric material and/or the liquid fabric-softening component are mixed together in a mixer having a tip speed of from 15 $ms^{-1}$ to 35 $ms^{-1}$.

Process of preparing the agglomerate of the present invention: The process comprises the step of agglomerating two or more particles of the present invention, optionally with a binder and optionally with a flow aid, to form an agglomerate.

Uses: The particle of the present invention is suitable to provide a fabric-softening benefit to fabric during a laundering process. The particle of the present invention is suitable to provide ease of ironing benefit to fabric during a laundering process. The particle of the present invention is suitable to provide anti-wrinkle benefit to fabric during a laundering process. The particle of the present invention is suitable to provide a color care benefit to fabric during a laundering process. The particle of the present invention is suitable to provide a fabric-integrity benefit to fabric during a laundering process. The particle of the present invention is suitable to provide a fabric hydrophobicity benefit to fabric during a laundering process. The particle of the present invention is suitable to provide a soil and/or stain repellency benefit to fabric during a laundering process.

The particle of the present invention is suitable to provide a tactual benefit to fabric during a laundering process. The particle of the present invention is suitable to provide a skin benefit during a hand laundering process. The particle of the present invention is suitable to provide accelerated drying of the fabric during the fabric treatment process. The particle of the present invention is suitable to control the suds profile of the composition during the laundering process.

EXAMPLES

Example 1

Method of Making a Particle 2,400 g of an aqueous octyl succinic acid (OSA) derivatized starch solution (Alcocap LNP 2004, 33 w/w % active) and 800 g of polydimethylsiloxane (PDMS 100000 cP) are mixed under high shear in a mixer (speed setting "5", Ultra Turrax T50). 80 g of cationic hydroxyethyl cellulose is then added to the mixture, which is mixed in a mixer (speed setting "5", Ultra Turrax T50) for 20 minutes to form an emulsion.

The resulting emulsion is sprayed into a Niro Mobile Minor spray dryer via a rotary atomizer (speed 28000 rpm) set with an inlet air temperature of 200° C. and at a rate sufficient to keep the outlet air temperature between 95° C. and 100° C. to form particles.

The particles are separated from the exiting airflow by a cyclone assembly for collection.

Example 2

Method of Making an Agglomerate a) 129.0 g of the particle of example 1 is dusted with 10.1 g of silica (Sipemat 22S, ex Degussa) in a Kenwood FP570 mixer for 10-20 seconds on the lowest speed setting (setting 1). The resultant material is then sieved through 250 um sieve by hand to remove any lumps.
b) 127.6 gs of the sieved material made in part a) is placed in a Kenwood FP570 mixer and mixed on the lowest speed setting (setting 1) whilst water is slowly added to start agglomeration (20.0 gs of water is added). 39.8 g of light sodium carbonate is then added as a dusting agent to the mix.
c) The "wet" agglomerate from step b) is then dried in the Niro small scale fluid bed, with an air inlet temperature of 80° C. for 10 minutes.
d) The dried material from step c) is then sieved through a 1400 um sieve.
e) The sieved material (<1400 um) from step d) is suitable for use in a laundry detergent composition and has the following composition:

5.44 wt % Silica
23.30 wt % Sodium Carbonate
2.00 wt % Water
69.26 wt % particle of example 1
  32.90% polydimethylsiloxane
  34.63% octyl succinic acid (OSA) derivatized starch
  1.73% cationic hydroxyethyl cellulose

Example 3

Laundry Detergent Composition 18 wt % anionic surfactant, 1 wt % nonionic surfactant, 1 wt % cationic surfactant, 7 wt % sodium percarbonate, 20 wt % sodium sulphate, 33 wt % sodium carbonate, 0.5 wt % perfume, 0.5 wt % enzyme, 14 wt % zeolite, 2 wt % water, moisture, 3 wt % agglomerate of example 2.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended

What is claimed is:

1. A particle comprising:
(a) from 40 wt % to 60 wt % solid film-forming polymeric material comprising an octyl succinic acid derivatized starch;
(b) from 40 wt % to 60 wt % of a liquid fabric-softening component comprising polydimethylsiloxane; and
(c) from 1 wt % to 10 wt % cationically charged polymeric material comprising cationic hydroxyl ethyl cellulose;
wherein said solid film-forming polymeric material encapsulates at least part of the liquid fabric-softening component.

2. A particle according to claim 1, wherein the liquid fabric-softening component further comprises one or more of mineral oil, vegetable oil, hydrogenated castor oil, polyol esters, fatty acids and hydrocarbons.

3. A fabric treatment composition comprising a particle according to claim 1.

4. An agglomerate comprising:
(a) two or more particles according to claim 1;
(b) a binder; and
(c) a flow aid.

5. A fabric treatment composition comprising an agglomerate according to claim 4.

6. A laundry detergent composition comprising a detersive surfactant and a particle according to claim 1.

7. A laundry detergent composition comprising an agglomerate according to claim 4.

8. A process of preparing a particle according to claim 1, the process comprises the steps of forming an emulsion with the liquid fabric-softening component wherein both the solid film-forming polymeric material and the charged polymeric material are in the form of an aqueous mixture when contacted with the liquid fabric-softening component.

* * * * *